United States Patent [19]

Pojbics et al.

[11] Patent Number: 4,539,087

[45] Date of Patent: Sep. 3, 1985

[54] METHOD FOR ELECTROLYTIC REMOVAL OF GALVANIC NICKEL, CHROMIUM OR GOLD LAYERS FROM THE SURFACE OF A COPPER OR COPPER ALLOY BASE AND APPARATUS FOR CARRYING OUT THE METHOD

[75] Inventors: Jenö Pojbics; Ferenc Magyar, both of Esztergom, Hungary

[73] Assignee: Latszereszeti Eszkozok Gyara, Esztergom, Hungary

[21] Appl. No.: 668,678

[22] Filed: Nov. 5, 1984

Related U.S. Application Data

[63] Continuation of Ser. No. 544,427, Oct. 21, 1983, abandoned.

[30] Foreign Application Priority Data

Oct. 29, 1982 [HU] Hungary ..... 3483

[51] Int. Cl.[3] ..... C25F 5/00; C25F 7/00

[52] U.S. Cl. ..... 204/146; 204/228

[58] Field of Search ..... 204/146, 228

[56] References Cited

U.S. PATENT DOCUMENTS

| | | | |
|---|---|---|---|
| 3,649,489 | 3/1972 | Dillenberg | 204/146 |
| 3,788,958 | 1/1974 | Dillenberg | 204/146 |
| 3,793,172 | 2/1974 | Cadieux | 204/146 |
| 3,826,724 | 7/1974 | Riggs, Jr. | 204/146 |
| 3,886,055 | 5/1975 | Baboian | 204/146 |
| 3,900,375 | 8/1975 | Baboian | 204/146 |
| 3,943,043 | 3/1976 | Billington | 204/146 |

*Primary Examiner*—Thomas Tufariello
*Attorney, Agent, or Firm*—Handal & Morofsky

[57] ABSTRACT

A method for electrolytic removal of a galvanic nickel, chromium or gold layer from a metal base of copper or copper alloy, which is carried out in a bath comprising sulphuric acid and phosphorous acid and/or an organic acid in a concentration, in which the potential of the outer layer is negative and that of the metal base is positive relative to the bath. With such conditions the outer layer will be electrolytically removed and the surface of the metal base gets passive. The removal is finished when the current through the bath decreases below a predetermined threshold value.

The apparatus for carrying out the method comprises a current sensor for detecting the current, and if the current decreases below the threshold value, the sensor turns on a current breaker for breaking the current through the bath.

9 Claims, 2 Drawing Figures

Figure 1:
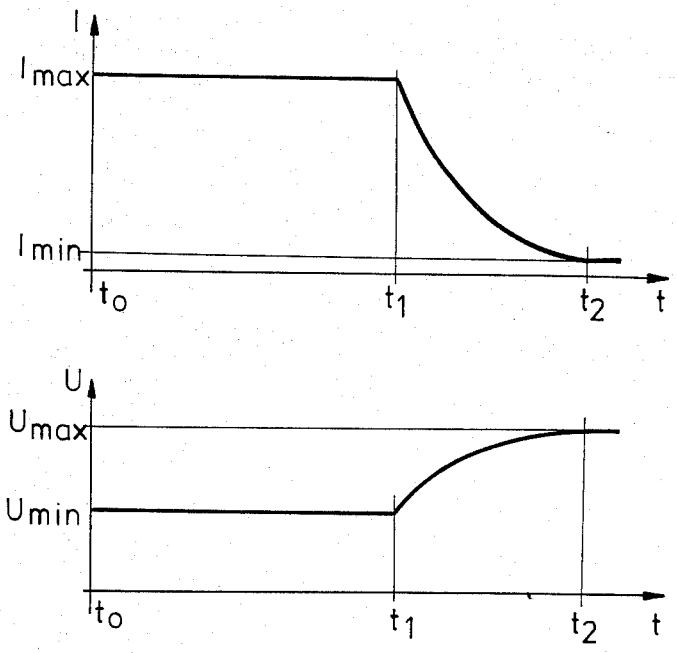

METHOD FOR ELECTROLYTIC REMOVAL OF GALVANIC NICKEL, CHROMIUM OR GOLD LAYERS FROM THE SURFACE OF A COPPER OR COPPER ALLOY BASE AND APPARATUS FOR CARRYING OUT THE METHOD

This application is a continuation of application Ser. No. 544,427 filed Oct. 21, 1983, was abandoned.

The invention relates to a method for electrolytic removal of galvanic nickel, chromium or gold layers from the surface of a copper or copper alloy base and to an apparatus for carrying out the method.

In the manufacture of articles covered by a galvanic nickel, chromium or gold layer it may happen that owing to faults in the electrolysis, in the polishing process or to other grounds the outer nickel, chromium or gold layer should be removed.

The galvanic removal of an electrolytic outer layer can be made in electrolytic baths capable of solving the layer to be removed. During such electrolytic removal it may occur that due to the uneven thickness of the layer the chromium, nickel or gold layer has already been removed from certain surface areas, while in other areas it is still present. In such cases the electrolysis should be continued and in the continued electrolysis the free base metal is involved and the outer surface thereof can be corroded unevenly. This means that in the removal process of a galvanic layer the surface of the base metal can also be damaged which increases manufacturing losses.

In about 30 to 40 percent of the cases following the removal of an original galvanic layer the surface of the base metal is damaged in an extent that the article should be disposed off and the remaining articles can be re-used following a further surface refining and polishing only. Of course, this proportion depends on the type of the articles and on the required surface smoothness.

The object of the invention is to provide a method by which the galvanic nickel, chromium or gold layer can be removed without damaging or very little damage to the surface of the base metal.

This object is solved by utilizing the discovery according to which the electrolytic removal should be solved under circumstances which impose a passivation effect on the surface of the base (or carrier) metal under the layer to be removed. In that case the metal surface freed during the removal will not participate any more in the electrolytic process, the current density flowing through this surface will be reduced substantially and the sudden decrease of the current indicates the end of the removal process.

In case of the electrolytic removal of a nickel, chromium or gold layer from the surface of a base metal made of copper or copper alloy these circumstances take place if the natural potential (i.e. when no outer voltage is used) of the layer to be removed relative to the bath is negative, and the natural potential of the base metal also relative to the bath is positive. If during the electrolytic removal the article is connected as an anode, the outer layer will be removed electrolytically, whereafter the surface of the base metal gets passivated. The composition of the bath should be chosen to satisfy this criterion. According to our experiments such properties have baths comprising sulfuric acid in 20 to 60 percent by volume and phosphoric acid and/or an organic acid in 10 to 50 percent by volume, which during the electrolysis of the base metal provide a pore-free passive surface.

As it is known in the art, under a galvanic gold layer there is generally an intermediate galvanic nickel layer. If the task lies only in the removal of the gold layer without affecting the nickel layer under it, then the potential of the bath should be adjusted so that the potential of the gold relative thereto be negative and that of the nickel be positive. In that case the concentration of the sulfuric acid in the bath should be between 40 and 60 percents by volume.

The organic acid which can be used beside the sulphuric acid can be acetic acid, oxalacetic acid, lactic acid or maleic acid. If no phosphorous acid is used, the concentration of the organic acid in the bath should be adjusted to reach at least 15 percent by volume.

Following the removal of the galvanic outer layer the character of the electrolytic process changes over to passivation indicated by the sudden drop in the current rate. During the performance of the process the magnitude of the current should be watched and the process can be completed when a sudden current drop is observed.

The sudden drop of the current can be used for automation of the electrolytic removal process.

An apparatus devised for carrying out the method comprises a direct current power supply coupled to anode and cathode electrodes in the bath, and a current sensor for watching the actual current value, and according to the invention the sensor is coupled to input of a comparator which has a reference input connected to a stabilized reference source, and the output of the comparator is coupled directly or through an amplifier to a current breaker inserted in the current path of the electrolyzation output. The turnover treshold level of the comparator is adjusted to a value, in which the turnover takes place if the current decreases substantially (e.g. by two decimal orders of magnitude), and in response to such a turnover the current breaker breaks the electrolytic circuit.

The technical solution according to the invention provides for the electrolytic removal of unwanted nickel, chromium or gold layers without the losses experienced during conventional removing methods and the manpower requirement and the energy consumption will also be reduced.

The invention will now be described in connection with examples and exemplary embodiments thereof, in which reference will be made to the accompanying drawings.

Figure 2:
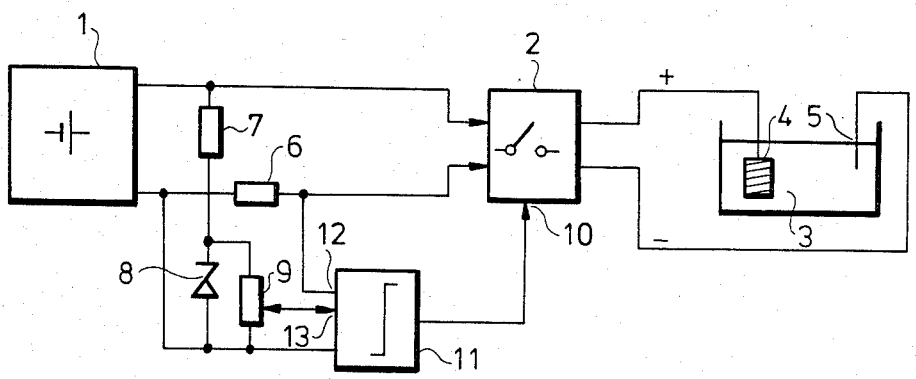

In the drawing:

FIG. 1 shows the voltage-current curve characteristic to the method according to the invention, and FIG. 2 shows the block diagram of the apparatus for carrying out the method.

During the method the article provided with a nickel, chromium or gold layer which is to be removed, is placed in a galvanic bath. The bath comprises sulphuric acid, acetic acid and preferably phosphorous acid. A preferably composition of a bath with phosphorous acid is:

| | |
|---|---|
| phosphorous acid | 30 to 60 percents by volume |
| sulphuric acid | 40 to 20 percents by volume |
| acetic acid | 30 to 20 percents by volume |

The composition of an other possible bath is:

| | |
|---|---|
| sulphuric acid | 30 percent by volume |
| acetic acid | 40 percent by volume |
| water | 30 percent by volume. |

A preferable bath for the removal of gold has the composition:

| | |
|---|---|
| phosphorus acid | 600 ml |
| sulphuric acid | 400 ml |
| oxalacetic acid | 100 g/l. |

The composition of a further preferable bath is:

| | |
|---|---|
| sulphuric acid | 50 percent by volume |
| phosphorous acid | 15 percent by volume |
| alcohol | 10 percent by volume |
| water | 25 percent by volume. |

The various additives influence the brightness of the passive surface remaining after the removal of the outer layer. The presence of oxalacetic acid in a concentration up to 15 g/l ensures a continuous brightness in case of gold removal.

Of course, in addition to the examples given hereinabove numerous other baths can be used, in which the concentration of sulphuric acid is between 20 and 60 percents by volume, and that of the organic acid and/or phosphorous acid is between 10 and 50 percents by volume.

In the bath with a composition referred to above, the current will be adjusted to a value corresponding to the polarization curve of the base metal to fall in the medium portion of the horizontal section thereof. During the electrolysis the nickel, chromium or gold layers will be removed like during a polishing process. Since the thickness of the layer is generally inhomogene, it may happen that in certain areas the layer has been already removed, while in other areas it has still some rests. The free surface of the base metal gets passivated, and the so established passive layer is electrically non-conductive, therefore very low current can only flow therethrough.

The curve of the voltage versus current during such an electrolytic process is shown in FIG. 1. Following a starting moment $t_o$ the current is at maximum $I_{max}$ with a voltage of $U_1$. This state lasts till moment $t_1$ when the galvanic layer gets being removed from the surface. Owing to passivation of the metal base the current continuously decreases and the voltage increases till it reaches a maximum $U_{max}$. In moment $t_2$ the current is at minimum $I_{min}$. By that time the original nickel, chromium or gold layer has been completely removed. A typical value for the quotient $I_{max}/I_{min}$ is about 100.

FIG. 2 shows the block diagram of an apparatus for carrying out the method according to the invention. The apparatus comprises a galvanic power supply 1 coupled through a current breaker 2 to anode and cathode electrodes 4 and 5 immersed in bath 3. The current is detected by resistor 6. A stabilized source including a resistor 7 and a zener diode 8 is coupled to the output of the power supply 1. A potentiometer 9 is connected to the output of the stabilized source. The current breaker 2 has a control input 10 connected directly or through an amplifier to output of comparator 11. The comparator 11 has a signal input connected to the current sensing resistor 6 and a reference input connected to the slider of the potentiometer 9. The lower terminal of the potentiometer 9 forms the zero-potential of the power supply of the comparator 9.

In operation the current breaker 2 provides a closed path for the current supplying the bath 3. If the current decreases below the minimum level $I_{min}$, then the voltage at the signal input 12 of the comparator 11 drops below the reference voltage, whereby the comparator 11 turns over and controls the current breaker 2 to break the circuit of the bath 3. By that time the electrolytic removal process has finished. It is preferable if an appropriate tone and/or voice signal is generated together with the operation of the current breaker 2.

I claim:

1. A method for the electrolytic removal of a galvanic nickel, chromium or gold layer from the surface of a metal base of copper or copper alloy, comprising the steps of:

(a) carrying out the electrolysis in a bath comprising 20 to 50 percent by volume of sulphuric acid, 30 to 60 percent by volume of phosphoric acid, and 20 to 30 percent by volume of an organic acid, wherein the natural potential of the layer to be removed relative to the bath is negative and the natural potential of the metal base relative to the bath is positive, (b) detecting the value of the current during the electrolysis, and (c) finally breaking the path of the current when the value thereof drops below a predetermined threshold which is substantially lower than the current at the beginning of the electrolysis.

2. The method as claimed in claim 1 wherein the bath comprises sulphuric acid in a concentration of between 20 and 50 percent by volume, and phosphoric acid in a concentration of between 10 to 50 percent by volume.

3. The method as claimed in claim 1, wherein said organic acid is made any of a series comprising acetic acid, oxalacetic acid, lactic acid and maleic acid.

4. The method as claimed in claim 1, wherein for the removal of a gold layer the bath comprises sulphuric acid in a concentration of at least 40 percents of volume.

5. The method as claimed in claim 3, wherein said bath is free of phosphoric acid and the concentration of said organic acid is at least 15 percents of volume.

6. Apparatus for carrying out the method as claimed in claim 1, comprising a power supply, a current breaker coupled to the output of the power supply, a pair of electrodes immersed in the bath and connected through the current breaker to the power supply, wherein a current sensor is inserted in the output path of the power supply (1), which is coupled to signal input (12) of a comparator (11), the comparator (11) has a reference input (13) connected to a reference source, and the output of the comparator (11) is coupled to the control input of the current breaker (2).

7. The apparatus as claimed in claim 6, characterized in that the current sensor is made by a resistor (6), and the reference source is composed of a stabilizator including a potentiometer (9) and a series member of a resistor (7) and a zener diode (8), said member is connected to the output of the power supply (1).

8. A method for the electrolytic removal of a galvanic nickel, chromium or gold layer from the surface of a metal base of copper or copper alloy, comprising the steps of:

(a) carrying out the electrolysis in a bath comprising sulphuric acid in a concentration between 20 and 30 percent by volume and organic acid in a concentration of 10 to 50 percent by volume, wherein the natural potential of the layer to be removed relative to the bath is negative and the natural potential of the metal base relative to the bath is positive, (b) detecting the value of the current during the electrolysis, and (c) finally breaking the path of the current when the value thereof drops below a predetermined threshold which is substantially lower than the current at the beginning of the electrolysis.

9. The method as claimed in claim 8, wherein said organic acid is acetic acid, oxalacetic acid, lactic acid or maleic acid.

* * * * *